US010449550B2

(12) United States Patent
Oki et al.

(10) Patent No.: US 10,449,550 B2
(45) Date of Patent: Oct. 22, 2019

(54) SORTING DEVICE AND SORTING METHOD

(71) Applicant: NATIONAL INSTITUTE OF ADVANCED INDUSTRIAL SCIENCE AND TECHNOLOGY, Tokyo (JP)

(72) Inventors: Tatsuya Oki, Ibaraki (JP); Tomohiro Noguchi, Ibaraki (JP); Taeko Hazumi, Ibaraki (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 15/317,505

(22) PCT Filed: Jun. 9, 2015

(86) PCT No.: PCT/JP2015/066560
§ 371 (c)(1),
(2) Date: Dec. 9, 2016

(87) PCT Pub. No.: WO2015/194416
PCT Pub. Date: Dec. 23, 2015

(65) Prior Publication Data

US 2017/0128952 A1 May 11, 2017

(30) Foreign Application Priority Data

Jun. 16, 2014 (JP) ..... 2014-123251

(51) Int. Cl.
*B03C 1/025* (2006.01)
*B03C 1/034* (2006.01)

(52) U.S. Cl.
CPC ..... *B03C 1/025* (2013.01); *B03C 1/034* (2013.01); *B03C 2201/18* (2013.01)

(58) Field of Classification Search
CPC ..... B03C 1/002; B03C 1/025; B03C 1/031; B03C 2201/18; B03C 1/032; B03C 1/033; B03C 1/034
(Continued)

(56) References Cited

U.S. PATENT DOCUMENTS 4,087,358 A * 5/1978 Oder ..... B01D 35/06 209/214
4,124,503 A * 11/1978 Watson ..... B03C 1/027 209/222
(Continued)

FOREIGN PATENT DOCUMENTS

JP 61-174910 A 8/1986
JP 61-278316 A 12/1986
(Continued)

OTHER PUBLICATIONS

English Translation of WO 2012/118221; Inventor: Akai et al.; Pub. Date: Jul. 9, 2012.*
(Continued)

*Primary Examiner* — Joseph C Rodriguez
(74) *Attorney, Agent, or Firm* — Pergament & Cepeda LLP; Milagros A. Cepeda; Edward D. Pergament

(57) ABSTRACT

The present invention provides a sorting device and a sorting method for sorting a magnetically attractable substance and a non-magnetically attractable substance from a sorting target using a high gradient magnetic separator.

9 Claims, 8 Drawing Sheets

(58) Field of Classification Search
USPC ..... 209/232
See application file for complete search history.

(56) References Cited

U.S. PATENT DOCUMENTS

| | | | | | |
|---|---|---|---|---|---|
| 4,249,994 | A * | 2/1981 | Dolle | B03C 1/032 210/222 |
| 4,414,116 | A * | 11/1983 | Nolan | B03C 1/032 210/695 |
| 4,424,124 | A | 1/1984 | Iannicelli | |
| 4,769,130 | A | 9/1988 | Christensen | |
| 4,784,758 | A | 11/1988 | Willis | |
| 5,137,629 | A * | 8/1992 | Dauchez | B03C 1/032 209/223.1 |
| 5,766,450 | A | 6/1998 | Herman et al. | |
| 6,425,802 | B1 * | 7/2002 | Custer | B24B 37/04 451/36 |
| 2016/0151788 | A1 | 6/2016 | Oki et al. | |

FOREIGN PATENT DOCUMENTS

| | | | | |
|---|---|---|---|---|
| JP | 63-062517 | A | 3/1988 | |
| JP | 04-087609 | A | 3/1992 | |
| JP | 05-123510 | A | 5/1993 | |
| JP | 2014-073479 | A | 4/2014 | |
| WO | WO-2012118221 | A1 * | 9/2012 | B03C 1/0332 |
| WO | 2014/208770 | A1 | 12/2014 | |

OTHER PUBLICATIONS

International Search Report dated Sep. 15, 2015, for corresponding International Patent Application No. PCT/JP2015/066560. (With English Translation).

Written Opinion dated Sep. 15, 2015, for corresponding International Patent Application No. PCT/JP2015/066560. (With English Translation).

International Preliminary Report on Patentability dated Dec. 20, 2016, for corresponding International Patent Application No. PCT/JP2015/066560.

Decision of Refusal, mailed by the Japanese Patent Office dated Jan. 9, 2018, for corresponding Japanese Patent Application No. JP 2016-529255. (With English Translation).

Extended European Search Report, mailed by the European Patent Office dated Jan. 30, 2018, for corresponding European Patent Application No. EP 15810576.

* cited by examiner

CONVENTIONAL SORTING DEVICE

CONVENTIONAL SORTING DEVICE

CONVENTIONAL SORTING DEVICE

SORTING DEVICE AND SORTING METHOD

This application is a National Phase application under 35 U.S.C. 371 of International Application No. PCT/JP2015/066560, filed on Jun. 9, 2015, which claims priority to Japanese provisional application No. 2014-123251, filed on Jun. 16, 2014, all of which are hereby incorporated by references in their entireties.

TECHNICAL FIELD

The present invention relates to a sorting device and a sorting method for sorting a magnetically attractable substance and a non-magnetically attractable substance from a sorting target using a high gradient magnetic separator.

BACKGROUND ART

There has long been known a magnetic separation method of placing ferromagnet thin lines (matrix) under a uniform magnetic field and generating a high magnetization gradient near the ferromagnet thin lines. The ferromagnet thin lines can be utilized as a magnetic filter, making it possible to magnetically separate a magnetically attractable substance, which is magnetically attracted to the ferromagnet thin lines, and a non-magnetically attractable substance, which is not magnetically attracted to the ferromagnet thin lines, in a sorting target fluid introduced into a flow path where the ferromagnet thin lines are disposed.

The magnetic separator based on the principle of the magnetic separation method has developed as a high gradient magnetic separator (HGMS; High Gradient Magnetic Separator) and even today, the high gradient magnetic separator has newly been being developed. Specifically, the high gradient magnetic separator has a main object to increase separation accuracy and separation efficiency between the magnetically attractable substance and the non-magnetically attractable substance. For example, one proposed method is blowing pressurized gas in a magnetically attractable substance recovering step in order for particles adsorbed onto the magnetic filter to be detached more easily (see Japanese Patent Application Laid-Open (JP-A) No. 05-123510).

However, the sorting devices utilizing the high gradient magnetic separator that have been proposed so far do not achieve a fundamental improvement in separation accuracy and separation efficiency. Referring to FIGS. 1A to 1C, this situation will be described taking as an example a Jones-type wet high gradient sorting device which is typical as the sorting device. FIGS. 1A to 1C are depictive diagrams depicting a conventional sorting device using a Jones-type wet high gradient magnetic separator.

As illustrated in FIG. 1A, a sorting device 100 includes as main members, a high gradient magnetic separating section 50 including an electromagnet 50*a*, a magnetic filter 50*b*, and a magnetic separation flow path 50*c*, a sorting target fluid introducing flow path 101*b* coupled to one end of the magnetic separation flow path 50*c* via an on-off valve 101*a* and capable of introducing a sorting target fluid into the magnetic separation flow path 50*c*, a non-magnetically attractable substance discharging flow path 103*b* coupled to the other end of the magnetic separation flow path 50*c* via an on-off valve 103*a* and capable of discharging from the magnetic separation flow path 50*c*, the sorting target fluid from which any magnetically attractable substance has been magnetically attracted to the magnetic filter 50*b*, a carrier fluid introducing flow path 104*b* coupled to the other end of the magnetic separation flow path 50*c* via an on-off valve 104*a* and capable of introducing into the magnetic separation flow path 50*c*, a carrier fluid (e.g., water) capable of carrying the magnetically attractable substance detached from the magnetic filter 50*b*, and a magnetically attractable substance discharging flow path 105*b* coupled to the one end of the magnetic separation flow path 50*c* via an on-off valve 105*a* and capable of discharging from the magnetic separation flow path 50*c*, the carrier fluid carrying the magnetically attractable substance detached from the magnetic filter 50*b*.

The sorting device 100 is configured to sort the magnetically attractable substance and the non-magnetically attractable substance by separating the magnetically attractable substance and the non-magnetically attractable substance from the sorting target fluid.

First, as illustrated by arrows in FIG. 1A, only the on-off valve 101*a* of the on-off valves on the one end of the magnetic separation flow path 50*c* is opened to the magnetic separation flow path 50*c* in a state that the electromagnet 50*a* is excited, to introduce into the magnetic separation flow path 50*c*, the sorting target fluid introduced into the sorting target fluid introducing flow path 101*b* by means of a pump 101*d* from a storing section 101*c* storing the sorting target fluid and have the magnetically attractable substance magnetically attracted to the magnetic filter 50*b*, and only the on-off valve 103*a* of the on-off valves on the other end of the magnetic separation flow path 50*c* is opened to discharge into the non-magnetically attractable substance discharging flow path 103*b*, the sorting target fluid from which the magnetically attractable substance has been magnetically attracted and recover the sorting target fluid into a non-magnetically attractable substance recovering section 103*c* (a non-magnetically attractable substance sorting step).

Next, as illustrated by arrows in FIG. 1C, only the on-off valve 104*a* of the on-off valves on the other end of the magnetic separation flow path 50*c* is opened to the magnetic separation flow path 50*c* in a state that the electromagnet 50*a* is released from excitation, to introduce the carrier fluid into the magnetic separation flow path 50*c* from the carrier fluid introducing flow path 104*b*, and only the on-off valve 105*a* of the on-off valves on the one end of the magnetic separation flow path 50*c* is opened to have the carrier fluid carry the magnetically attractable substance detached from the magnetic filter 50*c* to discharge the magnetically attractable substance from the magnetic separation flow path 50*c* into the magnetically attractable substance discharging flow path 105*b* and recover the magnetically attractable substance into a magnetically attractable substance recovering section 105*c* (a magnetically attractable substance sorting step).

In the sorting device 100, by operating each of the on-off valves to repeatedly perform the non-magnetically attractable substance sorting step and the magnetically attractable substance sorting step while switching them based on the magnetic attraction capability of the magnetic filter 50, it is possible to sort the magnetically attractable substance and the non-magnetically attractable substance by separating the magnetically attractable substance and the non-magnetically attractable substance from the sorting target fluid.

In the sorting device 100, however, upon switching between the non-magnetically attractable substance sorting step and the magnetically attractable substance sorting step, the sorting target fluid from which the magnetically attractable substance and the non-magnetically attractable substance have not yet been separated is retained in the magnetic separation flow path 50*c*, raising a problem with reduction in separation accuracy. Therefore, in order to perform separation with high accuracy, it is necessary to circulate substances that have once undergone sorting, as the sorting target fluid to repeat a similar sorting operation, resulting in reduction in separation efficiency.

Specifically, as illustrated in FIG. 1B, at the time of operation of the non-magnetically attractable substance sorting step, the non-sorted sorting target fluid not having undergone sorting by the magnetic filter 50*b* is retained on the one end of the magnetic separation flow path 50*c*. Also, the sorting target fluid from which the magnetically attractable substance has been attracted and which is to be discharged into the non-magnetically attractable substance discharging flow path 103*b* is retained on the other end of the magnetic separation flow path 50*c*. In this state, when the non-magnetically attractable substance sorting step is switched to the magnetically attractable substance sorting step by operating each of the on-off valves and the electromagnet 50*a*, the non-sorted sorting target fluid retained in the magnetic separation flow path 50*c*, and the sorting target fluid from which the magnetically attractable substance has been attracted and which is to be discharged into the non-magnetically attractable substance discharging flow path 103*b* are discharged to the magnetically attractable substance discharging flow path 105*b*. As a result, there is a problem with unintentional inclusion of the non-magnetically attractable substance in the magnetically attractable substance recovering section 105*c*.

SUMMARY OF INVENTION

Technical Problem

The present invention aims to overcome the various conventional problems described above and achieve the object described below. That is, an object of the present invention is to provide a sorting device and a sorting method for sorting a magnetically attractable substance and a non-magnetically attractable substance from a sorting target using a high gradient magnetic separator with high accuracy and high efficiency.

Solution to Problem

Solutions to the problems described above are as follows.

In one aspect, the present invention provides a sorting device, which is capable of sorting a magnetically attractable substance and a non-magnetically attractable substance by separating the magnetically attractable substance and the non-magnetically attractable substance from a sorting target fluid which is a mixture of the magnetically attractable substance and the non-magnetically attractable substance, the sorting device including:

- a high gradient magnetic separating section, which includes an electromagnet, a magnetic filter capable of attracting or detaching the magnetically attractable substance with a magnetic field generated by the electromagnet, and a magnetic separation flow path with the electromagnet disposed outside and the magnetic filter disposed inside;
- a sorting target fluid introducing flow path, which is coupled to one end of the magnetic separation flow path via a first on-off valve and is capable of introducing the sorting target fluid into the magnetic separation flow path;
- a first carrier fluid introducing flow path, which is coupled to the one end of the magnetic separation flow path via a second on-off valve and is capable of introducing into the magnetic separation flow path, a first carrier fluid capable of carrying the sorting target fluid;
- a non-magnetically attractable substance discharging flow path, which is coupled to other end of the magnetic separation flow path via a third on-off valve and is capable of discharging from the magnetic separation flow path, the sorting target fluid from which the magnetically attractable substance has been magnetically attracted to the magnetic filter, and the first carrier fluid;
- a second carrier fluid introducing flow path, which is coupled to the other end of the magnetic separation flow path via a fourth on-off valve and is capable of introducing into the magnetic separation flow path, a second carrier fluid capable of carrying the magnetically attractable substance detached from the magnetic filter; and
- a magnetically attractable substance discharging flow path, which is coupled to the one end of the magnetic separation flow path via a fifth on-off valve and is capable of discharging from the magnetic separation flow path, the second carrier fluid that carries the magnetically attractable substance detached from the magnetic filter.

In one variant, the present invention provides the sorting device according to the present invention, further including a residual substance discharging flow path, which is coupled to the other end of the magnetic separation flow path via a sixth on-off valve and is capable of discharging from the magnetic separation flow path, the first carrier fluid that carries a residual substance remaining in the magnetic filter.

In another variant, the present invention provides a sorting method for sorting a magnetically attractable substance and a non-magnetically attractable substance by separating the magnetically attractable substance and the non-magnetically attractable substance with the sorting device according to the present invention, the sorting method including:

- a non-magnetically attractable substance sorting step in which only the first on-off valve of the on-off valves on the one end of the magnetic separation flow path is opened to the magnetic separation flow path in a state that the electromagnet is excited, to introduce the sorting target fluid from the sorting target fluid introducing flow path and have the magnetically attractable substance magnetically attracted to the magnetic filter, and only the third on-off valve of the on-off valves on the other end of the magnetic separation flow path is opened to discharge into the non-magnetically attractable substance discharging flow path, the sorting target fluid from which the magnetically attractable substance has been magnetically attracted;
- a residual non-magnetically attractable substance sorting step in which after the non-magnetically attractable substance sorting step, only the second on-off valve of the on-off valves on the one end of the magnetic separation flow path is opened to the magnetic separation flow path in a state that the electromagnet is excited, to introduce a first carrier fluid from a first carrier fluid introducing flow path, and only the third on-off valve of the on-off valves on the other end of the magnetic separation flow path is opened to have the first carrier fluid carry the sorting target fluid in a state that the magnetically attractable substance remaining in the magnetic separation flow path has been magnetically attracted to the magnetic filter, to discharge the sorting target fluid into the non-magnetically attractable substance discharging flow path from the magnetic separation flow path; and a magnetically attractable substance sorting step in which after the residual non-magnetically attractable substance sorting step, only the fourth on-off valve of the on-off valves on the other end of the magnetic separation flow path is opened to the magnetic separation flow path in a state that the electromagnet is released from excitation, to introduce the second carrier fluid from a second carrier fluid introducing flow path, and only the fifth on-off valve of the on-off valves on the one end of the magnetic separation flow path is opened to have the second carrier fluid carry the magnetically attractable substance detached from the magnetic filter to discharge the magnetically attractable substance into the magnetically attractable substance discharging flow path from the magnetic separation flow path.

In one variant, the present invention provides the sorting method according to the present invention, wherein the non-magnetically attractable substance sorting step, the residual non-magnetically attractable substance sorting step, and the magnetically attractable substance sorting step are repeatedly performed as a series of steps.

In one variant, the present invention provides the sorting method according to the present invention, further including a residual substance discharging step, which is provided between the residual non-magnetically attractable substance sorting step and the magnetically attractable substance sorting step and in which only the second on-off valve of the on-off valves on the one end of the magnetic separation flow path is opened to the magnetic separation flow path in a state that the electromagnet is excited, to introduce the first carrier fluid from the first carrier fluid introducing flow path, and only the sixth on-off valve of the on-off valves on the other end of the magnetic separation flow path is opened to have the first carrier fluid carry a residual substance remaining in the magnetic filter, to discharge the residual substance into the residual substance discharging flow path from the magnetic separation flow path.

Advantageous Effects of Invention

According to the present invention, it is possible to overcome the various problems of the conventional techniques and provide a sorting device and a sorting method for sorting a magnetically attractable substance and a non-magnetically attractable substance from a sorting target using a high gradient magnetic separator with high accuracy and high efficiency.

DESCRIPTION OF EMBODIMENTS (Sorting Device)

Figure 1A:
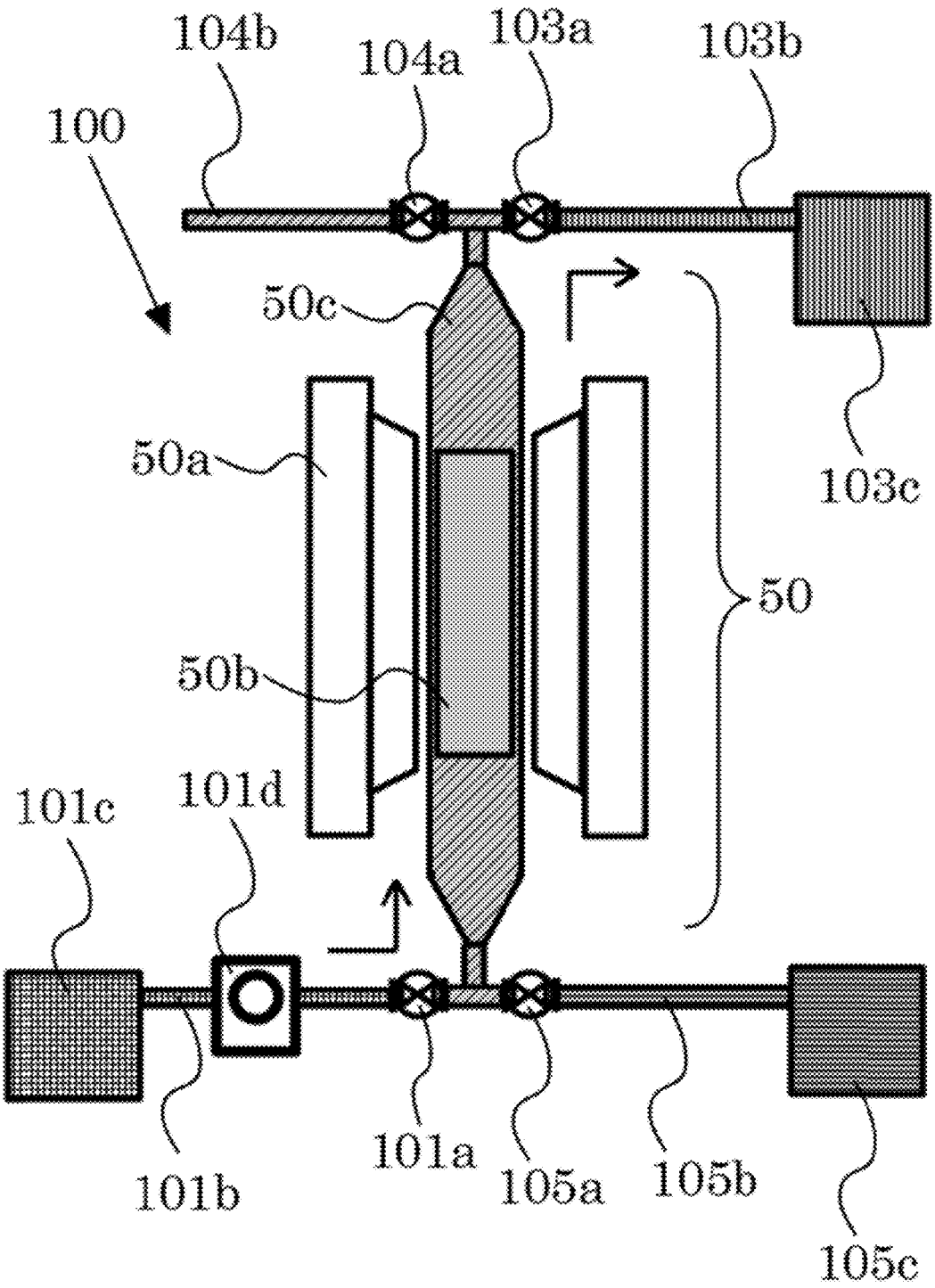
FIG. 1A is a depictive diagram (1) depicting a conventional sorting device using a Jones-type wet high gradient magnetic separator.

A sorting device of the present invention is a sorting device capable of sorting a magnetically attractable substance and a non-magnetically attractable substance by separating the magnetically attractable substance and the non-magnetically attractable substance from a sorting target fluid which is a mixture of the magnetically attractable substance and the non-magnetically attractable substance, the sorting device including a high gradient magnetic separating section, a sorting target fluid introducing flow path, a first carrier fluid introducing flow path, a non-magnetically attractable substance discharging flow path, a second carrier fluid introducing flow path, and a magnetically attractable substance discharging flow path, and if necessary, further includes optional members such as a residual substance discharging flow path.

So long as the sorting target fluid contains the magnetically attractable substance, the sorting target fluid is not particularly limited and can be applied to sorting by the sorting device. Examples of the sorting target fluid include fluidic substances containing solid materials containing the magnetically attractable substance, such as recycle samples, fluorescent substances, fluorescent lamp samples, samples produced from mines, and wrapping samples for foods and pharmaceuticals. Examples of the fluidic substances include slurry obtained by dispersing the solid materials in suspension liquids.

The magnetically attractable substance refers to a magnetically attractable substance that is set as being magnetically attractable by the magnetic filter described below. The target of this setting may include only a magnetically attractable substance having a high magnetic susceptibility, or may also include a magnetically attractable substance having a low magnetic susceptibility. That is, is it possible to set variably whether a substance is magnetically attractable by the magnetic filter or not, based on the level of the density of a magnetic flux generated by the electromagnet and the size of a magnetic gradient formed by the magnetic filter. Here, a magnetically attractable substance set as being magnetically attractable to the magnetic filter is referred to as the magnetically attractable substance, and any other substance than such a magnetically attractable substance is referred to as the non-magnetically attractable substance.

<High Gradient Magnetic Separating Section>

The high gradient magnetic separating section includes an electromagnet, a magnetic filter capable of attracting or detaching the magnetically attractable substance with a magnetic field generated by the electromagnet, and a magnetic separation flow path with the electromagnet disposed outside and the magnetic filter disposed inside.

The electromagnet is not particularly limited and may be appropriately selected depending on the intended purpose. Electromagnets used in known high gradient magnetic separators can widely be used.

The magnetic filter is not particularly limited and magnetic filters used in known high gradient magnetic separators can widely be used.

A material constituting the magnetic separation flow path is not particularly limited and may be appropriately selected depending on the intended purpose. Known pipes made of stainless steel and the like can widely be used.

<Sorting Target Fluid Introducing Flow Path>

The sorting target fluid introducing flow path is coupled to one end of the magnetic separation flow path via a first on-off valve and is capable of introducing the sorting target fluid into the magnetic separation flow path.

The first on-off valve is not particularly limited and may be appropriately selected depending on the intended purpose so long as the first on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the sorting target fluid introducing flow path is not particularly limited and may be appropriately selected depending on the intended purpose. Known pipes made of stainless steel and the like can widely be used.

Attachments of the sorting target fluid introducing flow path are not particularly limited. A pump configured to introduce the sorting target fluid into this flow path or a storing section storing the sorting target fluid may be coupled to the sorting target fluid introducing flow path.

<First Carrier Fluid Introducing Flow Path>

The first carrier fluid introducing flow path is coupled to the one end of the magnetic separation flow path via a second on-off valve and is capable of introducing into the magnetic separation flow path, a first carrier fluid capable of carrying the sorting target fluid.

Figure 1B:
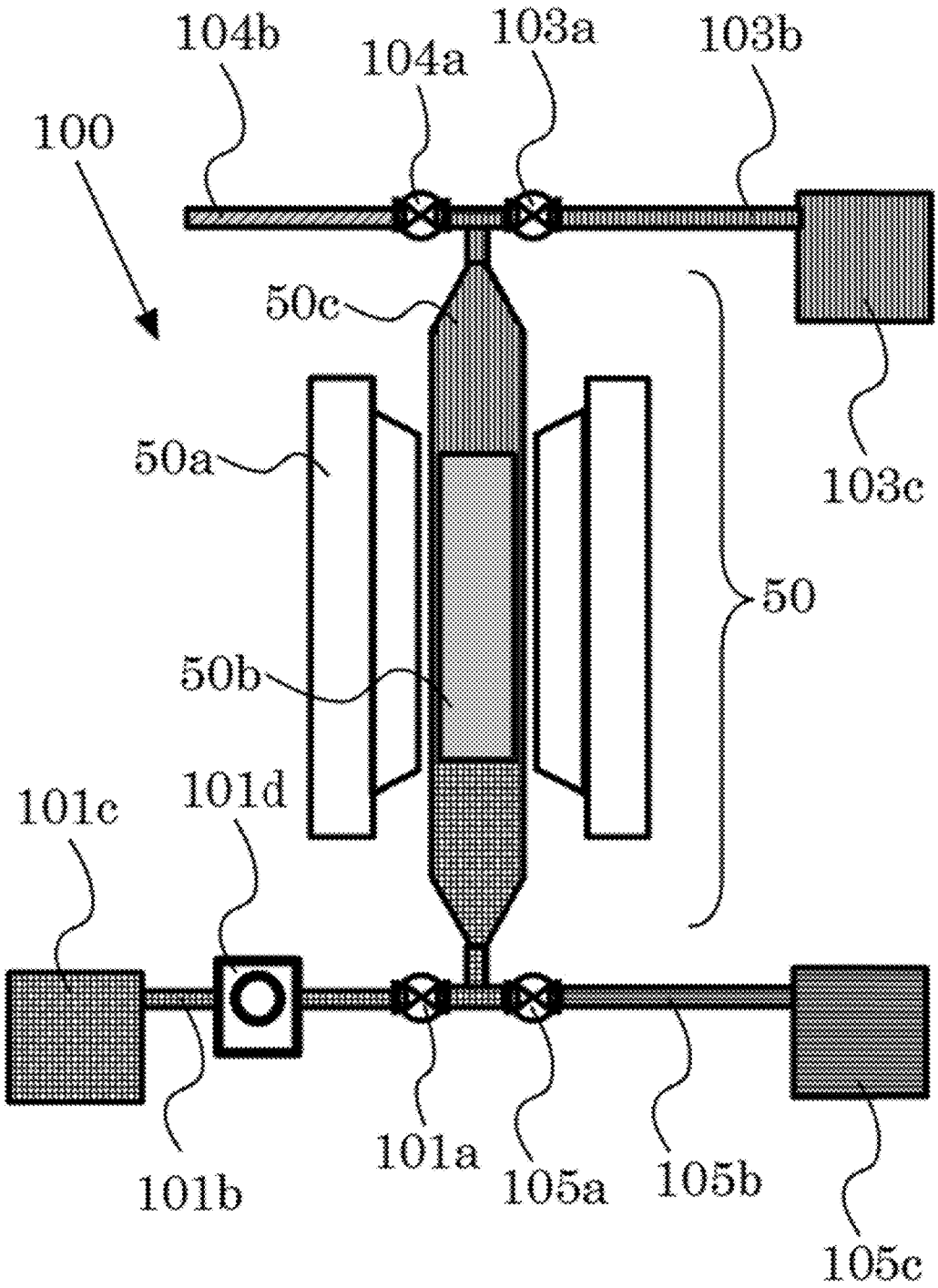
FIG. 1B is a depictive diagram (2) depicting a conventional sorting device using a Jones-type wet high gradient magnetic separator.
Figure 1C:
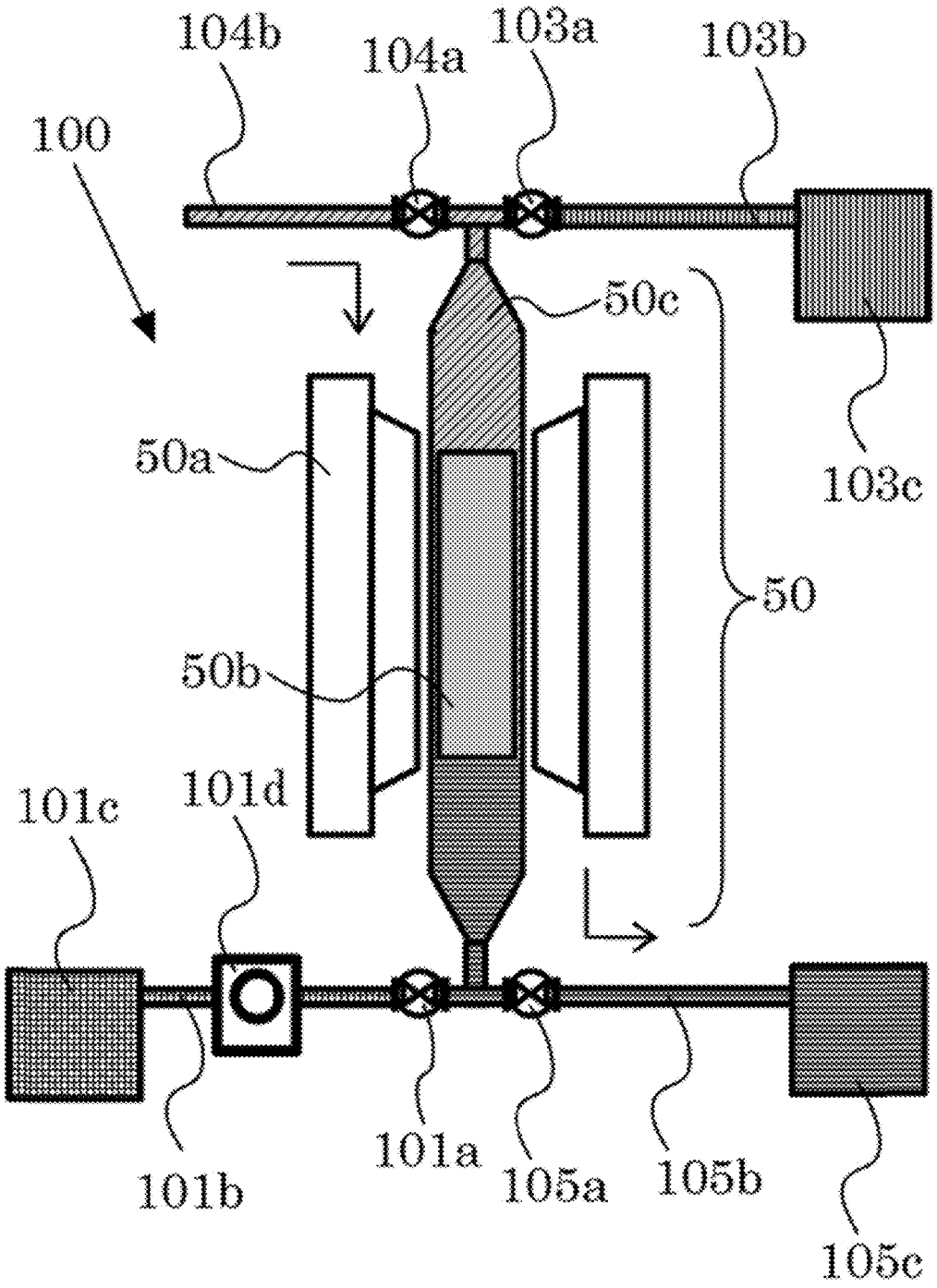
FIG. 1C is a depictive diagram (3) depicting a conventional sorting device using a Jones-type wet high gradient magnetic separator.

In the sorting device according to the present invention, this first carrier fluid introducing flow path is disposed, and after the operation of the non-magnetically attractable substance sorting step, the sorting target fluid retained in the magnetic separation flow path is carried by the first carrier fluid to the outside of the magnetic separation flow path. This makes it possible to overcome the problem described with reference to FIG. 1B that upon switching the non-magnetically attractable substance sorting step to the magnetically attractable substance sorting step in the conventional sorting device, the non-sorted sorting target fluid and the like retained in the magnetic separation flow path is discharged to the magnetically attractable substance discharging flow path.

The first carrier fluid is not particularly limited so long as the first carrier fluid is a fluid capable of carrying the sorting target fluid. Examples of the first carrier fluid include water. When the residual substance discharging flow path described below is disposed, various rinse liquids for washing (liquids to which known dispersing agents have been added) can be selected and used depending on the kind of the residual substance in terms of effectively washing away the residual substance remaining in the magnetic filter.

Similar to the first on-off valve, the second on-off valve is not particularly limited and may be appropriately selected depending on the intended purpose so long as the second on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the first carrier fluid introducing flow path is not particularly limited and may be appropriately selected depending on the intended purpose. Known pipes made of stainless steel and the like can widely be used.

Attachments of the first carrier fluid introducing flow path are not particularly limited. A pump configured to introduce the first carrier fluid into this flow path or a storing section storing the first carrier fluid may be coupled to the first carrier fluid introducing flow path. When water is used as the first carrier fluid, the first carrier fluid introducing flow path may be coupled to a water pipe. When water serving as the first carrier fluid and the rinse liquid other than water are used in combination, on-off valves can be separately disposed to selectively introduce them into the first carrier fluid introducing flow path.

<Non-magnetically Attractable Substance Discharging Flow Path>

The non-magnetically attractable substance discharging flow path is coupled to the other end of the magnetic separation flow path via a third on-off valve and is capable of discharging from the magnetic separation flow path, the sorting target fluid from which the magnetically attractable substance has been magnetically attracted to the magnetic filter, and the first carrier fluid.

Similar to the first on-off valve, the third on-off valve is not particularly limited and may be appropriately selected depending on the intended purpose so long as the third on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the non-magnetically attractable substance discharging flow path is not particularly limited and may be appropriately selected depending on the intended purpose. Known pipes made of stainless steel and the like can widely be used.

Attachments of the non-magnetically attractable substance discharging flow path are not particularly limited. Examples of the attachments include a non-magnetically attractable substance recovering section configured to recover the non-magnetically attractable substance. The non-magnetically attractable substance recovering section may be, for example, a common recovering container, or may be such a recovering container equipped with a filtration device configured to filter off the magnetically attractable substance that could not completely sorted by the magnetic filter. When the recovering container is disposed, the recovered substance may be introduced again into the sorting target fluid introducing flow path in order to sort the magnetically attractable substance that could not completely sorted by the magnetic filter.

<Second Carrier Fluid Introducing Flow Path>

The second carrier fluid introducing flow path is coupled to the other end of the magnetic separation flow path via a fourth on-off valve and is capable of introducing into the magnetic separation flow path, a second carrier fluid capable of carrying the magnetically attractable substance detached from the magnetic filter.

The second carrier fluid is not particularly limited so long as the second carrier fluid is a fluid capable of carrying the magnetically attractable substance. Examples of the second carrier fluid include water.

Similar to the first on-off valve, the fourth on-off valve is not particularly limited and may be appropriately selected depending on the intended purpose so long as the fourth on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the second carrier fluid introducing flow path is not particularly limited and may be appropriately selected depending on the intended purpose. Known pipes made of stainless steel and the like can widely be used.

Attachments of the second carrier fluid introducing flow path are not particularly limited. A pump configured to introduce the second carrier fluid into this flow path or a storing section storing the second carrier fluid may be coupled to the second carrier fluid introducing flow path. When water is used as the second carrier fluid, the second carrier fluid introducing flow path may be coupled to a water pipe.

<Magnetically Attractable Substance Discharging Flow Path>

The magnetically attractable substance discharging flow path is coupled to the one end of the magnetic separation flow path via a fifth on-off valve and is capable of discharging from the magnetic separation flow path, the second carrier fluid that carries the magnetically attractable substance detached from the magnetic filter.

Similar to the first on-off valve, the fifth on-off valve is not particularly limited and may be appropriately selected depending on the intended purpose so long as the fourth on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the magnetically attractable substance discharging flow path is not particularly limited and may be appropriately selected depending on the intended purpose. Known pipes made of stainless steel and the like can widely be used.

Attachments of the magnetically attractable substance discharging flow path are not particularly limited. Examples of the attachments include a magnetically attractable substance recovering section configured to recover the magnetically attractable substance. The magnetically attractable substance recovering section may be, for example, a common recovering container, or may be such a recovering container equipped with a filtration device configured to filter off the second carrier fluid and the magnetically attractable substance.

<Residual Substance Discharging Flow Path>

The residual substance discharging flow path is coupled to the other end of the magnetic separation flow path via a sixth on-off valve and is capable of discharging from the magnetic separation flow path, the first carrier fluid that carries the residual substance remaining in the magnetic filter.

In the sorting device according to the present invention, the first carrier fluid introducing flow path is disposed independently of the second carrier fluid introducing flow path, which makes it possible to introduce the rinse liquid as the first carrier fluid into the magnetic separation flow path to wash away the residual substance remaining in the magnetic filter (e.g., the magnetically attractable substance and suspended particles contained in the sorting target fluid) from the magnetic filter and discharge the residual substance from the magnetic separation flow path.

Similar to the first on-off valve, the sixth on-off valve is not particularly limited and may be appropriately selected depending on the intended purpose so long as the sixth on-off valve is controllable to be open or closed independently of other on-off valves. It is possible to use a known on-off valve physically independent of other on-off valves (a 2-way valve) or a known 3-way valve or 4-way valve integrally formed with other on-off valves.

Similar to the magnetic separation flow path, a material constituting the residual substance discharging flow path is not particularly limited and may be appropriately selected depending on the intended purpose. Known pipes made of stainless steel and the like can widely be used.

Attachments of the residual substance discharging flow path are not particularly limited. Examples of the attachments include a residual substance recovering section configured to recover the residual substance. The residual substance recovering section may be, for example, a common recovering container, or may be such a recovering container equipped with a filtration device configured to filter off the magnetically attractable substance, the suspended particles, and the like which have been washed away from the magnetic filter. The recovered substance recovered in the residual substance recovering section may again be circulated in and introduced into the sorting target fluid introducing flow path.

(Sorting Method)

A sorting method according to the present invention is a sorting method for sorting a magnetically attractable substance and a non-magnetically attractable substance by separating the magnetically attractable substance and the non-magnetically attractable substance with the sorting device of the present invention, the sorting method including a non-magnetically attractable substance sorting step, a residual non-magnetically attractable substance sorting step, and a magnetically attractable substance sorting step, and if necessary, further includes optional steps such as a residual substance discharging step. Explanation of the sorting device used for the operation of each of the steps will be omitted because it overlaps with the explanation in the sorting device.

<Non-magnetically Attractable Substance Sorting Step>

The non-magnetically attractable substance sorting step is a step in which only the first on-off valve of the on-off valves on the one end of the magnetic separation flow path is opened to the magnetic separation flow path in a state that the electromagnet is excited, to introduce into the magnetic separation flow path, the sorting target fluid from the sorting target fluid introducing flow path and have the magnetically attractable substance magnetically attracted to the magnetic filter, and only the third on-off valve of the on-off valves on the other end of the magnetic separation flow path is opened to discharge into the non-magnetically attractable substance discharging flow path, the sorting target fluid from which the magnetically attractable substance has been magnetically attracted.

<Residual Non-magnetically Attractable Substance Sorting Step>

The residual non-magnetically attractable substance sorting step is a step in which after the non-magnetically attractable substance sorting step, only the second on-off valve of the on-off valves on the one end of the magnetic separation flow path is opened to the magnetic separation flow path in a state that the electromagnet is excited, to introduce a first carrier fluid from a first carrier fluid introducing flow path, and only the third on-off valve of the on-off valves on the other end of the magnetic separation flow path is opened to have the first carrier fluid carry the sorting target fluid in a state that the magnetically attractable substance remaining in the magnetic separation flow path has been magnetically attracted to the magnetic filter, to discharge the sorting target fluid into the non-magnetically attractable substance discharging flow path from the magnetic separation flow path.

In the sorting method according to the present invention, after the operation of the non-magnetically attractable substance sorting step, the sorting target fluid retained in the magnetic separation flow path is carried by the first carrier fluid as the sorting target fluid from which the magnetically attractable substance has been magnetically attracted to the magnetic filter, to discharge the sorting target fluid to the outside of the magnetic separation flow path. This makes it possible to overcome the problem described with reference to FIG. 1B that upon switching the non-magnetically attractable substance sorting step to the magnetically attractable substance sorting step in the conventional sorting device, the non-sorted sorting target fluid and the like retained in the magnetic separation flow path is discharged to the magnetically attractable substance discharging flow path.

<Magnetically Attractable Substance Sorting Step>

The magnetically attractable substance sorting step is a step in which after the residual non-magnetically attractable substance sorting step, only the fourth on-off valve of the on-off valves on the other end of the magnetic separation flow path is opened to the magnetic separation flow path in a state that the electromagnet is released from excitation, to introduce the second carrier fluid from a second carrier fluid introducing flow path, and only the fifth on-off valve of the on-off valves on the one end of the magnetic separation flow path is opened to have the second carrier fluid carry the magnetically attractable substance detached from the magnetic filter to discharge the magnetically attractable substance into the magnetically attractable substance discharging flow path from the magnetic separation flow path.

The non-magnetically attractable substance sorting step, the residual non-magnetically attractable substance sorting step, and the magnetically attractable substance sorting step are not particularly limited but these steps are preferably performed as a series of steps. Specifically, it is preferable that after the magnetically attractable substance sorting step, the process be returned again to the non-magnetically attractable substance sorting step to perform the steps sequentially and successively. By operating the successive treatments in this cycle, it is possible to effectively sort the magnetically attractable substance and the non-magnetically attractable substance from the sorting target fluid. Switching from the non-magnetically attractable substance sorting step to the residual non-magnetically attractable substance sorting step can be performed through appropriate adjustment based on the magnetic attraction capability of the magnetic filter. Switching from the residual non-magnetically attractable substance sorting step to the magnetically attractable substance sorting step can be performed through appropriate adjustment of the timing when the non-sorted sorting target fluid and the like retained in the magnetic separation flow path after the operation of the non-magnetically attractable substance sorting step are completely discharged to the outside of the magnetic separation flow path.

<Residual Substance Discharging Step>

The residual substance discharging step is a step which is provided between the residual non-magnetically attractable substance sorting step and the magnetically attractable substance sorting step and in which only the second on-off valve of the on-off valves on the one end of the magnetic separation flow path is opened to the magnetic separation flow path in a state that the electromagnet is excited, to introduce the first carrier fluid from the first carrier fluid introducing flow path, and only the sixth on-off valve of the on-off valves on the other end of the magnetic separation flow path is opened to have the first carrier fluid carry a residual substance remaining in the magnetic filter, to discharge the residual substance into the residual substance discharging flow path from the magnetic separation flow path.

In the sorting method according to the present invention, the first carrier fluid is introduced independently of the second carrier fluid, which makes it possible to introduce the rinse liquid as the first carrier fluid into the magnetic separation flow path to wash away the residual substance remaining in the magnetic filter (e.g., the magnetically attractable substance and suspended particles contained in the sorting target fluid) from the magnetic filter and discharge the residual substance from the magnetic separation flow path.

When the non-magnetically attractable substance sorting step, the residual non-magnetically attractable substance sorting step, and the magnetically attractable substance sorting step are performed as a series of steps, the residual substance discharging step can also be performed as the series of steps. In this case, in the magnetically attractable substance sorting step operated after the residual substance discharging step, it is possible to recover a high purity of the magnetically attractable substance that is suppressed in inclusion of the residual substance, especially particles other than the magnetically attractable substance.

Embodiments of the sorting device and the sorting method according to the present invention described above will now be described in more detail with reference to FIGS. 2A to 2D. FIGS. 2A to 2D are each a depictive diagram depicting the sorting device according to one embodiment of the present invention.

Figure 2A:
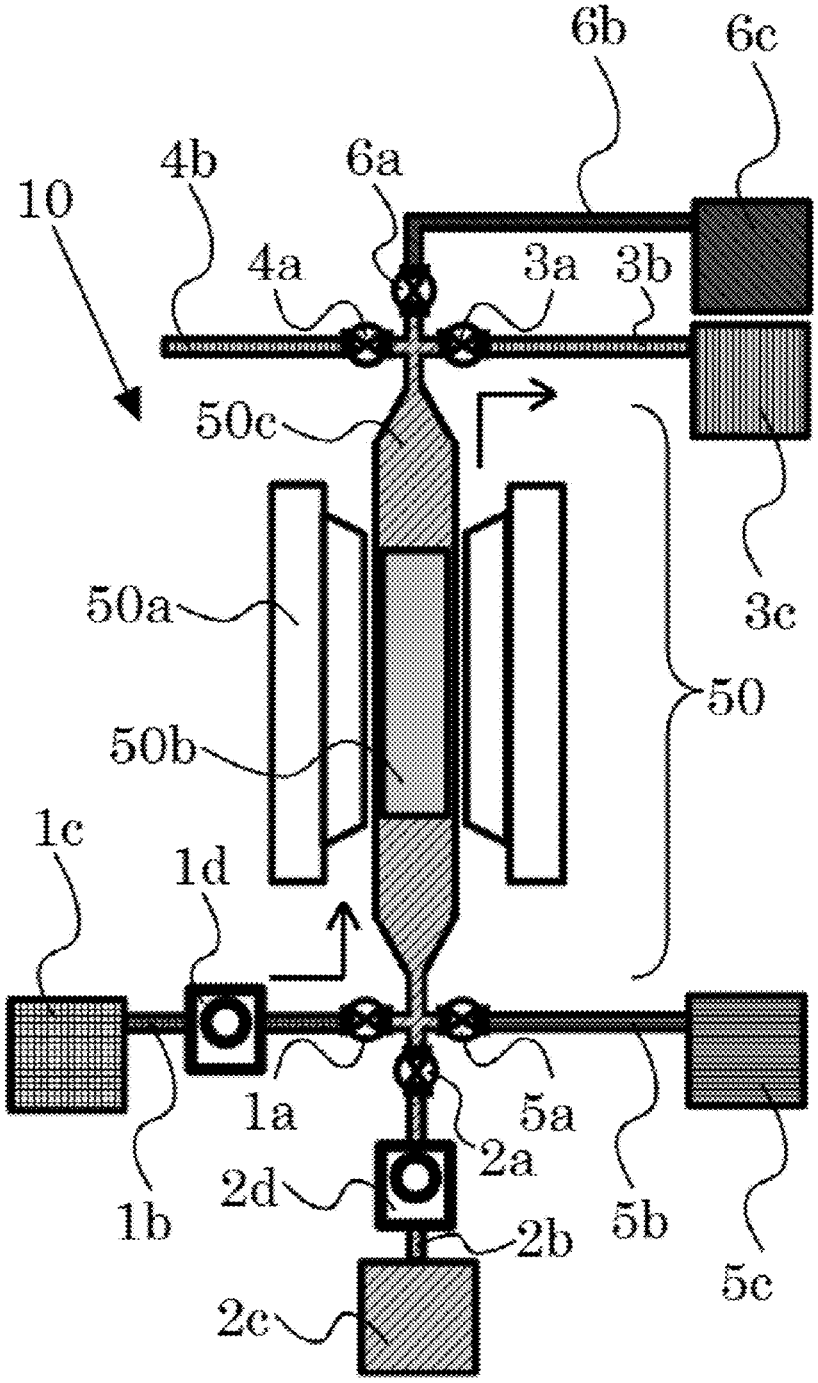
FIG. 2A is a depictive diagram (1) depicting a sorting device according to one embodiment of the present invention.
Figure 2B:
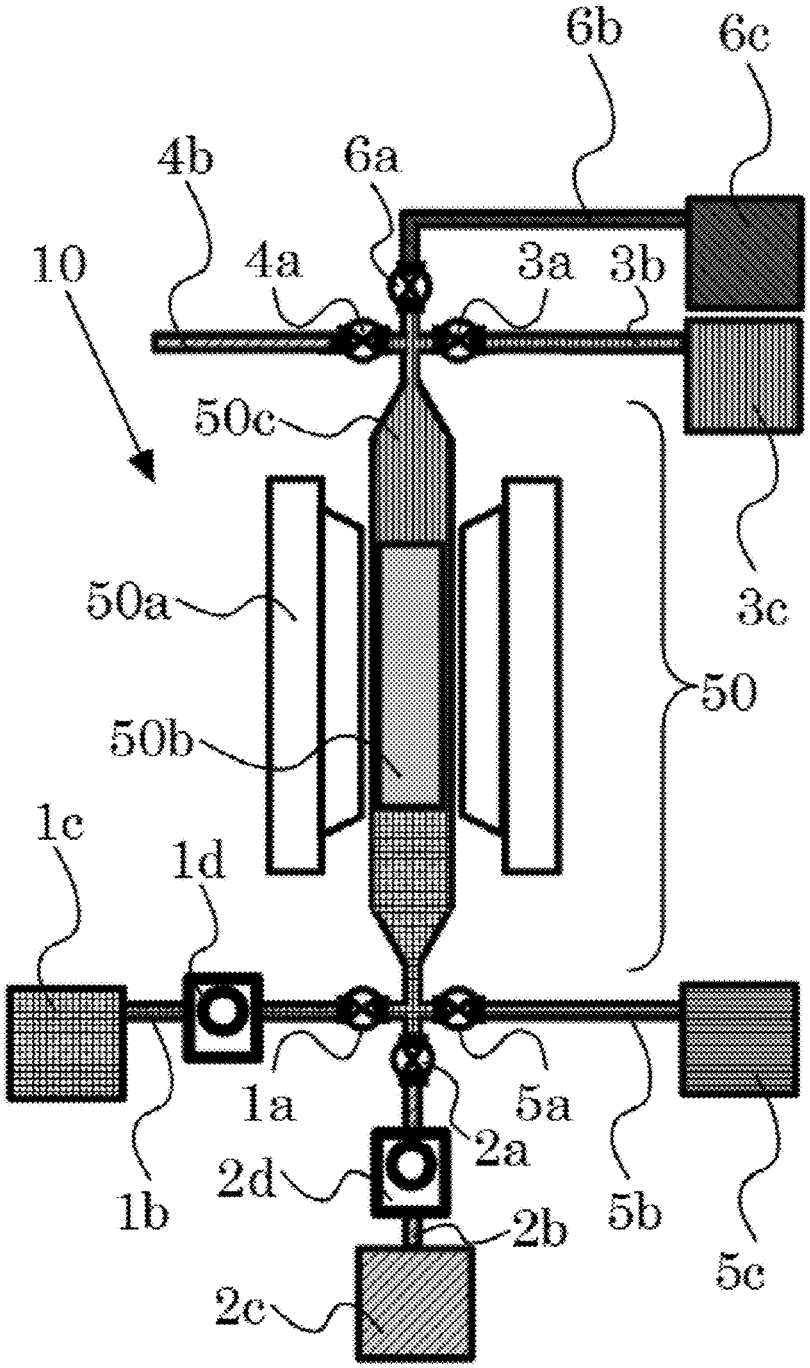
FIG. 2B is a depictive diagram (2) depicting a sorting device according to one embodiment of the present invention.

As illustrated in FIG. 2A, a sorting device 10 includes as main members: a high gradient magnetic separating section 50 composed of an electromagnet 50*a*, a magnetic filter 50*b*, and a magnetic separation flow path 50*c*; a sorting target fluid introducing flow path 1*b* coupled to one end of the magnetic separation flow path 50*c* via a first on-off valve 1*a* and capable of introducing the sorting target fluid into the magnetic separation flow path 50*c*; a first carrier fluid introducing flow path 2*b* coupled to the one end of the magnetic separation flow path 50*c* via a second on-off valve 2*a* and capable of introducing the first carrier fluid (e.g., water) capable of carrying the sorting target fluid to the magnetic separation flow path 50*c*; a non-magnetically attractable substance discharging flow path 3*b* coupled to the other end of the magnetic separation flow path 50*c* via a third on-off valve 3*a* and capable of discharging from the magnetic separation flow path 50*c*, the sorting target fluid in a state that the magnetically attractable substance is magnetically attracted to the magnetic filter 50*b*; a carrier fluid introducing flow path 4*b* coupled to the other end of the magnetic separation flow path 50*c* via a fourth on-off valve 4*a* and capable of introducing into the magnetic separation flow path 50*c*, a second carrier fluid (e.g., water) capable of carrying the magnetically attractable substance detached from the magnetic filter 50*b*; a magnetically attractable substance discharging flow path 5*b* coupled to the one end of the magnetic separation flow path 50*c* via a fifth on-off valve 5*a* and capable of discharging from the magnetic separation flow path 50*c*, the carrier fluid that carries the magnetically attractable substance detached from the magnetic filter 50*b*; and a residual substance discharging flow path 6*b* coupled to the other end of the magnetic separation flow path 50*c* via a sixth on-off valve 6*a* and capable of discharging from the magnetic separation flow path 50*c*, the first carrier fluid (e.g., a rinse liquid) that carries the residual substance remaining in the magnetic filter 50*b* (e.g., the magnetically attractable substance and suspended particles contained in the sorting target fluid).

In this figure, 2-way valves are used as the first on-off valve 1*a*, the second on-off valve 2*a*, and the fifth on-off valve 5*a* disposed on the one end of the magnetic separation flow path 50*c*. However, these on-off valves may be integrated as a 3-way valve or 4-way valve. Similarly, 2-way valves are used as the third on-off valve 3*a*, the fourth on-off valve 4*a*, and the sixth on-off valve 6*a* disposed on the other end of the magnetic separation flow path 50*c*. However, these on-off valves may be integrated as a 3-way valve or 4-way valve.

The sorting device 10 uses the following sorting method to sort the magnetically attractable substance and the non-magnetically attractable substance by separating them from the sorting target fluid. Additionally, as an optional step, washing of the magnetic filter 50*b* is performed.

First, as illustrated by arrows in FIG. 2A, only the first on-off valve 1*a* of the on-off valves on the one end of the magnetic separation flow path 50*c* is opened to the magnetic separation flow path 50*c* in a state that the electromagnet 50*a* is excited, to introduce into the magnetic separation flow path 50*c*, the sorting target fluid introduced into the sorting target fluid introducing flow path 1*b* by means of a pump 1*d* from a storing section 1*c* storing the sorting target fluid and have the magnetically attractable substance magnetically attracted to the magnetic filter 50*b*, and only the third on-off valve 3*a* of the on-off valves on the other end of the magnetic separation flow path 50*c* is opened to discharge into the non-magnetically attractable substance discharging flow path 3*b*, the sorting target fluid from which the magnetically attractable substance has been magnetically attracted and recover the sorting target fluid into a non-magnetically attractable substance recovering section 3*c* (the non-magnetically attractable substance sorting step). The magnetic separation flow path 50*c* after the non-magnetically attractable substance sorting step retains, on the one end thereof, the non-sorted sorting target fluid not having undergone sorting by the magnetic filter 50*b*. Also, the magnetic separation flow path 50*c* retains, on the other end thereof, the sorting target fluid from which the magnetically attractable substance has been attracted and which is to be discharged into the non-magnetically attractable substance discharging flow path 3*b* (see FIG. 2B).

Figure 2C:
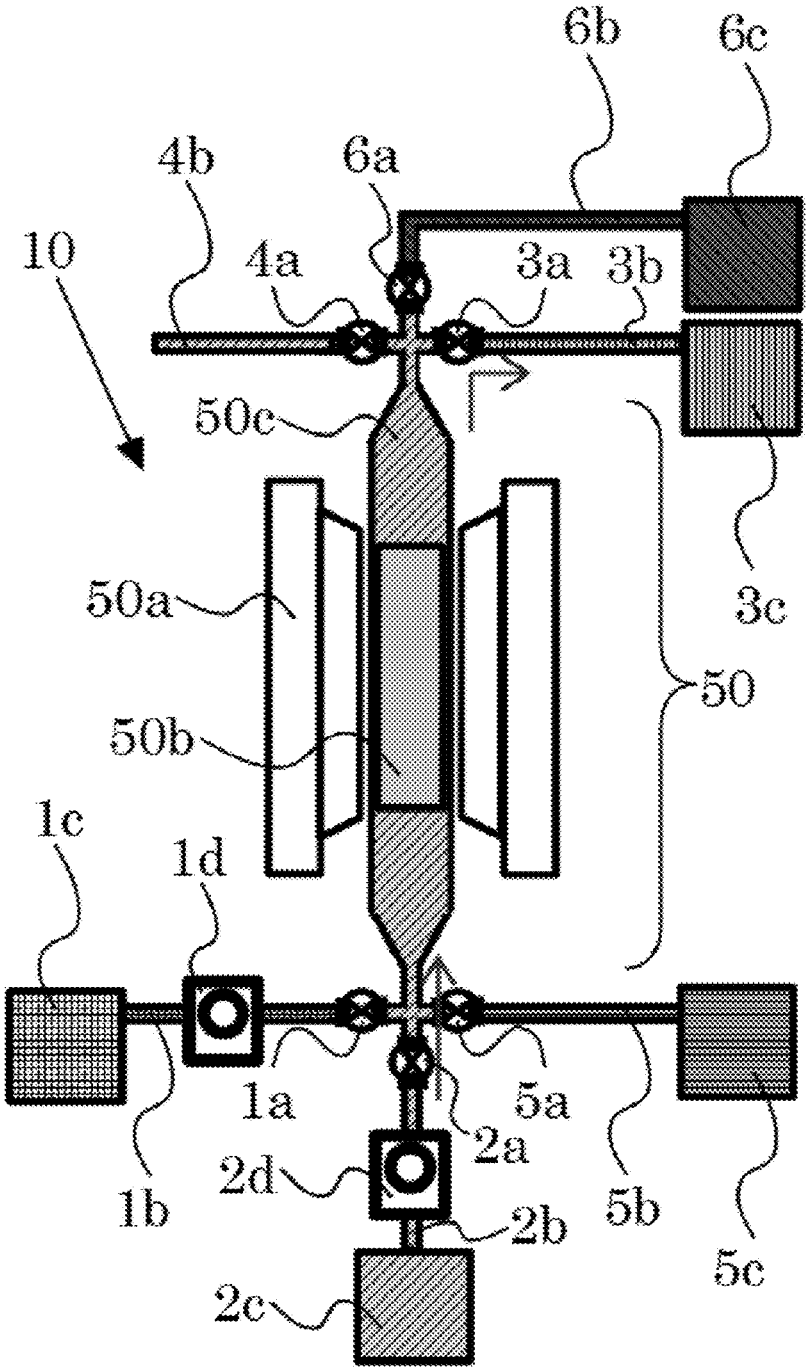
FIG. 2C is a depictive diagram (3) depicting a sorting device according to one embodiment of the present invention.

Next, as illustrated by arrows in FIG. 2C, after the non-magnetically attractable substance sorting step, only the second on-off valve 2*a* of the on-off valves on the one end of the magnetic separation flow path 50*c* is opened to the magnetic separation flow path 50*c* in a state that the electromagnet 50*a* is excited, to introduce from the first carrier fluid introducing flow path 2*b*, the first carrier fluid stored and the like in a storing second 2*c*, and only the third on-off valve 3*a* of the on-off valves on the other end of the magnetic separation flow path 50*c* is opened to have the first carrier fluid carry the non-sorted sorting target fluid and the like remaining in the magnetic separation flow path 50*c*, to discharge the non-sorted sorting target fluid and the like into the non-magnetically attractable substance discharging flow path 3*b* from the magnetic separation flow path 50*c* and recover the non-sorted sorting target fluid and the like into a non-magnetically attractable substance recovering section 3*c* (the residual non-magnetically attractable substance sorting step).

Figure 2D:
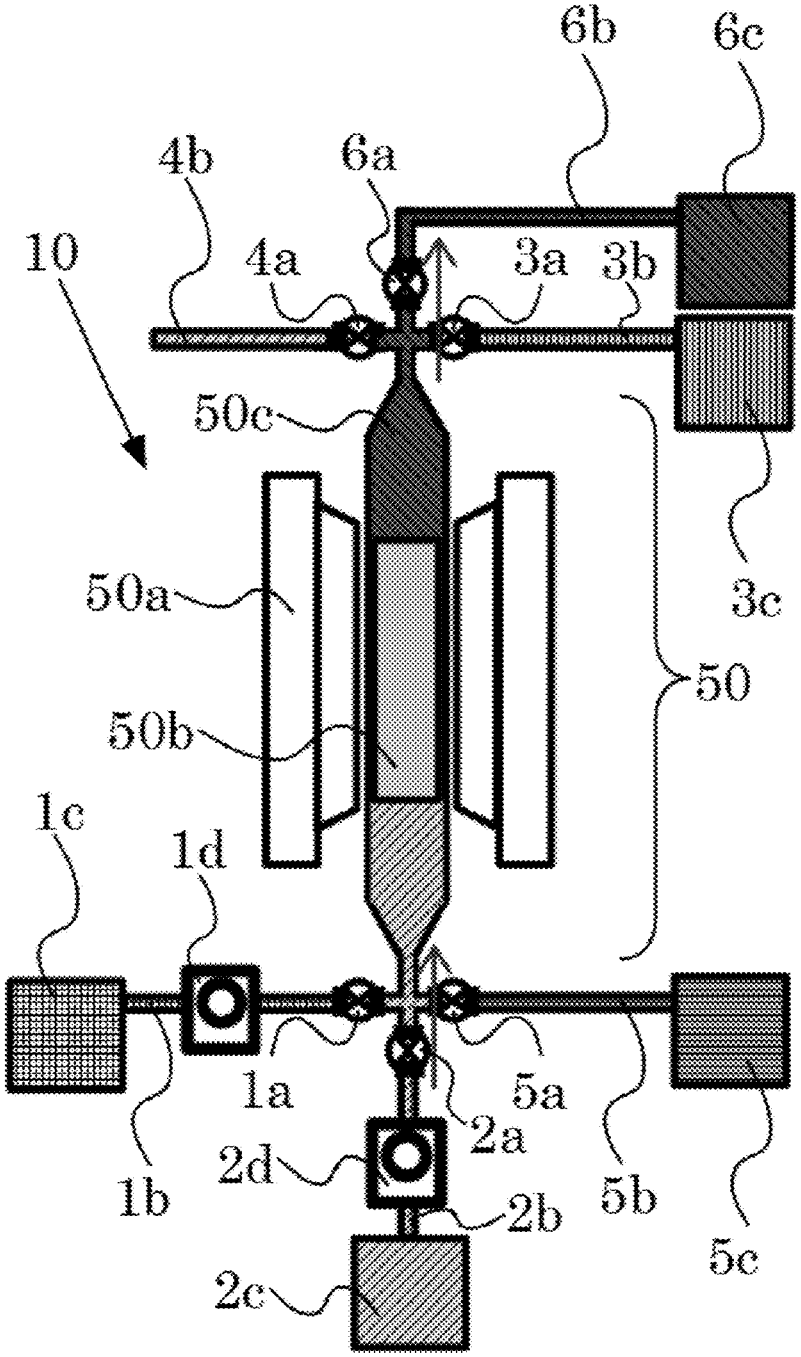
FIG. 2D is a depictive diagram (4) depicting a sorting device according to one embodiment of the present invention.

Next, as illustrated by arrows in FIG. 2D, only the second on-off valve 2*a* of the on-off valves on the one end of the magnetic separation flow path 50*c* is opened to the magnetic separation flow path 50*c* in a state that the electromagnet 50*a* is excited, to introduce the first carrier fluid (e.g., a rinse liquid) from the first carrier fluid introducing flow path 2*b*, and only the sixth on-off valve 6*a* of the on-off valves on the other end of the magnetic separation flow path 50*c* is opened to have the first carrier fluid carry the residual substance remaining in the magnetic filter 50*b* (e.g., the magnetically attractable substance and suspended particles contained in the sorting target fluid), to discharge the residual substance from the magnetic separation flow path 50*c* into a residual substance discharging flow path 6*b* and recover the residual substance into a residual substance recovering section 6*c* (the residual substance discharging step).

Figure 2E:
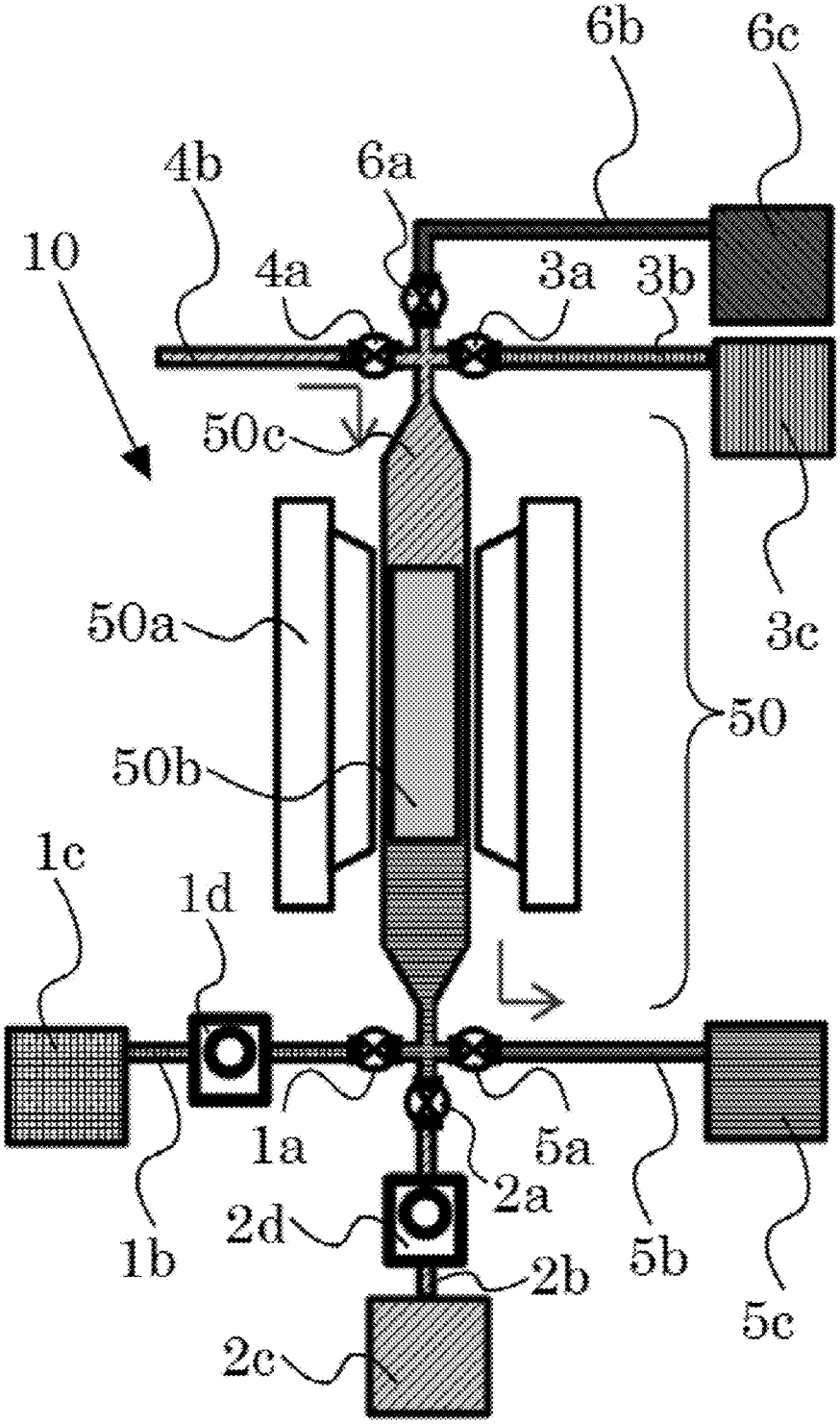
FIG. 2E is a depictive diagram (5) depicting a sorting device according to one embodiment of the present invention.

Next, as illustrated by arrows in FIG. 2E, only the fourth on-off valve 4*a* of the on-off valves on the other end of the magnetic separation flow path 50*c* is opened to the magnetic separation flow path 50*c* in a state that the electromagnet 50*a* is released from excitation, to introduce the second carrier fluid from the second carrier fluid introducing flow path 4*b*, and only the fifth on-off valve 5*a* of the on-off valves on the one end of the magnetic separation flow path 50*c* is opened to have the second carrier fluid carry the magnetically attractable substance detached from the magnetic filter 50*c*, to discharge the magnetically attractable substance from the magnetic separation flow path 50*c* into the magnetically attractable substance discharging flow path 5*b* and recover the magnetically attractable substance into a magnetically attractable substance recovering section 5*c* (the magnetically attractable substance sorting step).

In the sorting device 10, the first carrier fluid introducing flow path 2*a* is disposed and the residual non-magnetically attractable substance sorting step is performed, which makes it possible to, after non-magnetically attractable substance sorting step, have the first carrier fluid carry the non-sorted sorting target fluid and the like remaining in the magnetic separation flow path 50*c*, to discharge the non-sorted sorting target fluid and the like into the non-magnetically attractable substance discharging flow path 3*b* and recover into the non-magnetically attractable substance recovering section 3*c*, the sorting target fluid from which the magnetically attractable substance has been magnetically attracted to the magnetic filter 50*b*. In addition, the first carrier fluid introducing flow path 2*a* is disposed and the residual substance sorting step using the first carrier fluid (a rinse liquid) independent of the second carrier fluid is performed, which makes it possible to wash away the residual substance remaining in the magnetic filter 50*b* (e.g., the magnetically attractable substance and suspended particles contained in the sorting target fluid) from the magnetic filter 50*b* and suppress inclusion of the residual substance, especially particles other than the magnetically attractable substance, in the magnetically attractable substance recovering section 5*c*, to thereby recover a high purity of the magnetically attractable substance.

Therefore, it is possible to sort the magnetically attractable substance and the non-magnetically attractable substance from the sorting target fluid with high accuracy and high efficiency.

REFERENCE SIGNS LIST

1*a* first on-off valve
1*b* sorting target fluid introducing flow path
1*c* storing section
1*d* pump
2*a* second on-off valve
2*b* first carrier fluid introducing flow path
2*c* storing section
3*a* third on-off valve
3*b* non-magnetically attractable substance discharging flow path
3*c* non-magnetically attractable substance recovering section
4*a* fourth on-off valve
4*b* second carrier fluid introducing flow path
5*a* fifth on-off valve
5*b* magnetically attractable substance discharging flow path
5*c* magnetically attractable substance recovering section
6*a* sixth on-off valve
6*b* residual substance discharging flow path
6*c* residual substance recovering section
10, 100 sorting device
50 high gradient magnetic separating section
50*a* electromagnet
50*b* magnetic filter
50*c* magnetic separation flow path
101*a*, 103*a*, 104*a*, 105*a* on-off valve
101*b* sorting target fluid introducing flow path
101*c* storing section
101*d* pump
103*b* non-magnetically attractable substance discharging flow path
103*c* non-magnetically attractable substance recovering section
104*b* carrier fluid introducing flow path
105*b* magnetically attractable substance discharging flow path
105*c* magnetically attractable substance recovering section

The invention claimed is:

1. A high gradient magnetic separating sorting device, which is capable of sorting a magnetically attractable substance and a non-magnetically attractable substance by separating the magnetically attractable substance and the non-magnetically attractable substance from a sorting target fluid which is a mixture of the magnetically attractable substance and the non-magnetically attractable substance, the sorting device comprising:

a high gradient magnetic separating section, which includes electromagnets disposed to face each other, a magnetic filter capable of attracting or detaching the magnetically attractable substance with a parallel magnetic field generated by the electromagnets, and a magnetic separation flow path with the electromagnets disposed outside and the magnetic filter disposed inside;

a sorting target fluid introducing flow path, which is coupled to one end of the magnetic separation flow path via a first on-off valve and is capable of introducing the sorting target fluid into the magnetic separation flow path;

a first carrier fluid introducing flow path, which is coupled to the one end of the magnetic separation flow path via a second on-off valve and is capable of introducing into the magnetic separation flow path, a first carrier fluid containing a dispersing agent and capable of carrying the sorting target fluid;

a non-magnetically attractable substance discharging flow path, which is coupled to other end of the magnetic separation flow path via a third on-off valve and is capable of discharging from the magnetic separation flow path, the sorting target fluid from which the magnetically attractable substance has been magnetically attracted to the magnetic filter, and the first carrier fluid;

a second carrier fluid introducing flow path, which is coupled to the other end of the magnetic separation flow path via a fourth on-off valve and is capable of introducing into the magnetic separation flow path, a second carrier fluid capable of carrying the magnetically attractable substance detached from the magnetic filter; and a magnetically attractable substance discharging flow path, which is coupled to the one end of the magnetic separation flow path via a fifth on-off valve and is capable of discharging from the magnetic separation flow path, the second carrier fluid that carries the magnetically attractable substance detached from the magnetic filter, wherein the sorting device comprises the first on-off valve, the second on-off valve, and the fifth on-off valve near one end of the magnetic filter, and wherein the sorting device comprises the third on-off valve and the fourth on-off valve near the other end of the magnetic filter.

2. The sorting device according to claim 1, further comprising a residual substance discharging flow path, which is coupled to the other end of the magnetic separation flow path via a sixth on-off valve and is capable of discharging from the magnetic separation flow path, the first carrier fluid that carries a residual substance remaining in the magnetic filter.

3. A high gradient magnetic separating sorting method for sorting a magnetically attractable substance and a non-magnetically attractable substance by separating the magnetically attractable substance and the non-magnetically attractable substance with a sorting device which is capable of sorting a magnetically attractable substance and a non-magnetically attractable substance by separating the magnetically attractable substance and the non-magnetically attractable substance from a sorting target fluid which is a mixture of the magnetically attractable substance and the non-magnetically attractable substance, where the sorting device includes: a high gradient magnetic separating section, which includes electromagnets disposed to face each other, a magnetic filter capable of attracting or detaching the magnetically attractable substance with a parallel magnetic field generated by the electromagnets, and a magnetic separation flow path with the electromagnets disposed outside and the magnetic filter disposed inside; a sorting target fluid introducing flow path, which is coupled to one end of the magnetic separation flow path via a first on-off valve and is capable of introducing the sorting target fluid into the magnetic separation flow path; a first carrier fluid introducing flow path, which is coupled to the one end of the magnetic separation flow path via a second on-off valve and is capable of introducing into the magnetic separation flow path, a first carrier fluid containing a dispersing agent and capable of carrying the sorting target fluid; a non-magnetically attractable substance discharging flow path, which is coupled to other end of the magnetic separation flow path via a third on-off valve and is capable of discharging from the magnetic separation flow path, the sorting target fluid from which the magnetically attractable substance has been magnetically attracted to the magnetic filter, and the first carrier fluid; a second carrier fluid introducing flow path, which is coupled to the other end of the magnetic separation flow path via a fourth on-off valve and is capable of introducing into the magnetic separation flow path, a second carrier fluid capable of carrying the magnetically attractable substance detached from the magnetic filter; and a magnetically attractable substance discharging flow path, which is coupled to the one end of the magnetic separation flow path via a fifth on-off valve and is capable of discharging from the magnetic separation flow path, the second carrier fluid that carries the magnetically attractable substance detached from the magnetic filter, the sorting method comprising:

a non-magnetically attractable substance sorting step in which only the first on-off valve of the on-off valves on the one end of the magnetic separation flow path is opened to the magnetic separation flow path in a state that the electromagnets are excited, to introduce the sorting target fluid from the sorting target fluid introducing flow path and have the magnetically attractable substance magnetically attracted to the magnetic filter, and only the third on-off valve of the on-off valves on the other end of the magnetic separation flow path is opened to discharge into the non-magnetically attractable substance discharging flow path, the sorting target fluid in a state that the magnetically attractable substance is magnetically attracted;

a residual non-magnetically attractable substance sorting step in which after the non-magnetically attractable substance sorting step, only the second on-off valve of the on-off valves on the one end of the magnetic separation flow path is opened to the magnetic separation flow path in a state that the electromagnets are excited, to introduce a first carrier fluid from a first carrier fluid introducing flow path, and only the third on-off valve of the on-off valves on the other end of the magnetic separation flow path is opened to have the first carrier fluid carry the sorting target fluid in a state that the magnetically attractable substance remaining in the magnetic separation flow path has been magnetically attracted to the magnetic filter, to discharge the sorting target fluid into the non-magnetically attractable substance discharging flow path from the magnetic separation flow path; and a magnetically attractable substance sorting step in which after the residual non-magnetically attractable substance sorting step, only the fourth on-off valve of the on-off valves on the other end of the magnetic separation flow path is opened to the magnetic separation flow path in a state that the electromagnets are released from excitation, to introduce the second carrier fluid from a second carrier fluid introducing flow path, and only the fifth on-off valve of the on-off valves on the one end of the magnetic separation flow path is opened to have the second carrier fluid carry the magnetically attractable substance detached from the magnetic filter to discharge the magnetically attractable substance into the magnetically attractable substance discharging flow path from the magnetic separation flow path, wherein the sorting device comprises the first on-off valve, the second on-off valve, and the fifth on-off valve near one end of the magnetic filter, and wherein the sorting device comprises the third on-off valve and the fourth on-off valve near the other end of the magnetic filter.

4. The sorting method according to claim 3, wherein the non-magnetically attractable substance sorting step, the residual non-magnetically attractable substance sorting step, and the magnetically attractable substance sorting step are repeatedly performed as a series of steps.

5. The sorting method according to claim 3, further comprising a residual substance discharging step, which is provided between the residual non-magnetically attractable substance sorting step and the magnetically attractable substance sorting step and in which only the second on-off valve of the on-off valves on the one end of the magnetic separation flow path is opened to the magnetic separation flow path in a state that the electromagnets are excited, to introduce the first carrier fluid from the first carrier fluid introducing flow path, and only the sixth on-off valve of the on-off valves on the other end of the magnetic separation flow path is opened to have the first carrier fluid carry a residual substance remaining in the magnetic filter, to discharge the residual substance into the residual substance discharging flow path from the magnetic separation flow path.

6. The sorting method according to claim 4, further comprising a residual substance discharging step, which is provided between the residual non-magnetically attractable substance sorting step and the magnetically attractable substance sorting step and in which only the second on-off valve of the on-off valves on the one end of the magnetic separation flow path is opened to the magnetic separation flow path in a state that the electromagnets are excited, to introduce the first carrier fluid from the first carrier fluid introducing flow path, and only the sixth on-off valve of the on-off valves on the other end of the magnetic separation flow path is opened to have the first carrier fluid carry a residual substance remaining in the magnetic filter, to discharge the residual substance into the residual substance discharging flow path from the magnetic separation flow path.

7. The sorting device according to claim 2, further comprising a circulating flow path, which is configured to circulate a recovered substance to the sorting target fluid introducing flow path, the recovered substance being recovered in at least one of:

a non-magnetically attractable substance recovering section, which is coupled to the non-magnetically attractable substance discharging flow path and is configured to recover the non-magnetically attractable substance; and a residual substance recovering section, which is coupled to the residual substance discharging flow path and is configured to recover the residual substance.

8. The sorting method according to claim 5, further comprising circulating a recovered substance to the sorting target fluid introducing flow path, the recovered substance being recovered in at least one of:

a non-magnetically attractable substance recovering section, which is coupled to the non-magnetically attractable substance discharging flow path and is configured to recover the non-magnetically attractable substance; and a residual substance recovering section, which is coupled to the residual substance discharging flow path and is configured to recover the residual substance.

9. The sorting method according to claim 3, wherein the first carrier fluid is selected from fluid capable of carrying the sorting target fluid.

* * * * *